US006616012B2

(12) United States Patent
Dark

(10) Patent No.: US 6,616,012 B2
(45) Date of Patent: Sep. 9, 2003

(54) FLUID DISPENSING VALVE AND METHOD OF USE

(76) Inventor: Richard C. G. Dark, 2248 Gum Tree La., Fallbrook, CA (US) 92028

( * ) Notice: Subject to any disclaimer, the term of this patent is extended or adjusted under 35 U.S.C. 154(b) by 0 days.

(21) Appl. No.: 10/005,866

(22) Filed: Nov. 8, 2001

(65) Prior Publication Data

US 2003/0085240 A1 May 8, 2003

Related U.S. Application Data

(60) Provisional application No. 60/308,332, filed on Jul. 27, 2001.

(51) Int. Cl.[7] ..... G01F 11/00
(52) U.S. Cl. ..... 222/1; 222/212; 222/494
(58) Field of Search ..... 222/1, 212, 213, 222/481.5, 490, 494

(56) References Cited

U.S. PATENT DOCUMENTS

| | | | | | |
|---|---|---|---|---|---|
| 4,442,947 | A | | 4/1984 | Banich, Sr. | 215/344 |
| 4,506,809 | A | * | 3/1985 | Corsette | 137/493 |
| 4,728,006 | A | | 3/1988 | Drobish et al. | 222/181 |
| 4,785,978 | A | * | 11/1988 | Kano et al. | 215/309 |
| 5,005,737 | A | | 4/1991 | Rohr | 222/212 |
| 5,169,035 | A | | 12/1992 | Imbery, Jr. | 222/212 |
| 5,240,149 | A | * | 8/1993 | Schmidt | 137/102 |
| 5,271,531 | A | | 12/1993 | Rohr et al. | 222/212 |
| 5,390,805 | A | | 2/1995 | Bilani et al. | 215/260 |
| 5,687,882 | A | * | 11/1997 | Mueller | 222/212 |
| 5,785,196 | A | | 7/1998 | Montgomery | 215/354 |
| 5,842,618 | A | | 12/1998 | Julemont et al. | 222/490 |
| 5,862,955 | A | * | 1/1999 | Albini et al. | 222/212 |
| 5,954,237 | A | | 9/1999 | Lampe et al. | 222/153.06 |
| 6,062,436 | A | | 5/2000 | Fuchs | 222/212 |
| 6,116,457 | A | | 9/2000 | Haberman | 220/703 |

* cited by examiner

*Primary Examiner*—Joseph A. Kaufman
(74) *Attorney, Agent, or Firm*—Eric Karich

(57) ABSTRACT

A fluid dispensing valve for controlling the flow of a fluid from a container has a cap, a retainer, and a dispensing valve body. The cap is adapted to engage the container and includes a spout that defines a through-conduit having a top opening, a bottom opening, and an interior spout surface shaped to receive the dispensing valve body. The retainer includes at least one flow aperture and an upwardly extending plug having a plug shoulder. The dispensing valve body is bounded by an exterior surface, an interior surface, a valve perimeter, and a dispensing orifice perimeter. When the dispensing valve body is positioned on the retainer, the dispensing orifice perimeter fits securely around and seals against the upwardly extending plug; and the valve perimeter forms a sealing relationship with the interior spout surface. The retainer engages the spout to seal the dispensing valve body within the spout.

5 Claims, 3 Drawing Sheets

FLUID DISPENSING VALVE AND METHOD OF USE

CROSS-REFERENCE TO RELATED APPLICATIONS

This application for a utility patent claims the benefit of U.S. Provisional Application No. 60/308,332, filed Jul. 27, 2001.

STATEMENT REGARDING FEDERALLY SPONSORED RESEARCH

Not Applicable

BACKGROUND OF THE INVENTION

1. Field of the Invention

This invention relates generally to fluid dispensing valves, and more particularly to a fluid dispensing valve that is adapted to prevent the flow of a fluid through the valve until the fluid is forced through the valve with a sustained pressure, such as when the container is squeezed by a user, or when the user attempts to suck the fluid from the container.

2. Description of Related Art

Various manufacturers have attempted to develop a valve that is adapted to prevent the flow of a fluid through the valve until the fluid is forced through the valve with a sustained pressure, such as when the container is squeezed by a user, or when the user attempts to suck the fluid from the container. A goal of the valve is to prevent fluid flow when the container is knocked over or inverted, but to allow a large volume of fluid to flow when the user wanted to drink from the container.

The state of the art in this field is described in Dark, U.S. Pat. No. 6,250,503 ("the Dark reference"), hereby incorporated by reference. The Dark reference describes a dispensing closure for controlling the flow of a fluid from a container. The dispensing closure includes a conduit having an interior conduit surface partially blocked by a top retainer and a bottom retainer. The dispensing closure further includes a fluid dispensing valve that includes a resilient dome area and a seal area. The seal area extends outwardly, and preferably downwardly, from the dome perimeter to define a seal perimeter shaped to conform to the interior conduit surface to form a seal when the fluid dispensing valve is operably positioned within the conduit between the top and bottom retainers. At least one rib fixedly connects the seal area to the dome area such that deformation of the dome area is transmitted through the at least one rib to the seal area to disrupt the seal and form at least one dispensing flow path. Air pressure on an exterior seal surface of the seal area causes the seal area to deform between the at least one rib to form at least one venting flow path.

Prior to the Dark reference, various dispensing closures have also been designed to fit on the container for dispensing beverages, liquids, soaps and other fluent materials. Such closures are also often used on a baby drinking cup or cyclist water bottle whereupon the beverage would be dispensed by sucking on the closure or by squeezing the container.

Prior art closures primarily utilize a silicone dome dispensing system whereby the dome is penetrated by a pair of slits. The slits on the prior art domed surfaces open like petals when sufficient force is pushed upon it by the difference in the pressure in the container as compared to the pressure outside the container. Examples of these constructions are taught in Drobish et al., U.S. Pat. No. 4,768,006 and Rohr, U.S. Pat. Nos. 5,005,737 and 5,271,531.

There are several important disadvantages to the prior art construction. First, the slits used in the prior art are not effective in preventing accidental leakage if the container is bumped or dropped. Second, the slits must be added after the rubber dome is molded and therefore require a second operation, which adds to the cost of manufacturing the product.

Another prior art dispensing closure is shown in Imbery, Jr., U.S. Pat. No. 5,169,035. The Imbery, Jr. valve is excellent at venting air back into the container without allowing leakage through the venting flow path; however, the Imbery, Jr. closure does not teach a mechanism to control the outward flow of the fluid through the primary conduit.

Various other mechanisms are taught in Lampe et al., U.S. Pat. No. 5,954,237, Bilani et al., U.S. Pat. No. 5,390,805, Haberman, U.S. Pat. No. 6,116,457, Fuchs, U.S. Pat. No. 6,062,436, Montgomery, U.S. Pat. No. 5,785,196, Banich, Sr., U.S. Pat. No. 4,442,947, and Julemont et al., U.S. Pat. No. 5,842,618.

In order to be effective, the fluid dispensing valve must meet three conditions. First, the valve should not dispense if the container is bumped or accidentally squeezed slightly. Second, the valve should vent and allow air to pass back through it into the container to make up the volume it has dispensed. Third, the valve must be inexpensive to manufacture.

While the valve taught by Dark is presently the preferred mechanism for meeting these objectives, the mechanism disclosed by the Dark reference is sometimes not able to dispense large enough volumes of fluid without using a mechanism that is too large for the container. The remaining prior art does not teach a valve that meets all three requirements of an effective fluid dispensing valve. The present invention fulfills these needs and provides further related advantages as described in the following summary.

The prior art teaches closure mechanisms that provide some of the benefits described above; however, the prior art does not teach a closure mechanism having a valve that meets the requirements described above, and yet still allows a large volume of fluid to flow when required. The present invention fulfills these needs and provides further related advantages as described in the following summary.

SUMMARY OF THE INVENTION

The present invention teaches certain benefits in construction and use which give rise to the objectives described below.

The present invention provides a fluid dispensing valve for controlling the flow of a fluid from a container. The fluid dispensing valve includes a cap, a retainer, and a dispensing valve body. The cap is adapted to engage the container and includes a spout that defines a through-conduit having a top opening, a bottom opening, and an interior spout surface shaped to receive the dispensing valve body. The retainer includes at least one flow aperture and an upwardly extending plug having a plug shoulder. The dispensing valve body is bounded by an exterior surface, an interior surface, a valve perimeter, and a dispensing orifice perimeter. When the dispensing valve body is positioned on the retainer, the dispensing orifice perimeter fits securely around and seals against the upwardly extending plug; and the valve perimeter forms a sealing relationship with the interior spout surface. The retainer engages the spout to seal the dispensing valve body within the spout.

A primary objective of the present invention is to provide a fluid dispensing valve having advantages not taught by the prior art.

Another objective is to provide a fluid dispensing valve that closes a container and does not leak if the container is knocked over or inverted, or in response to minor or momentary jolts, bumps, and spills Another objective is to provide a fluid dispensing valve that easily and freely dispenses large volumes of the fluid in response to sustained forces such as squeezing the container or sucking upon the spout.

Another objective is to provide a fluid dispensing valve that can dispense thick fluids such as shampoo, liquid soap, and ketchup.

A further objective is to provide a fluid dispensing valve that allows air to vent back into the container once the fluid has been dispensed.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
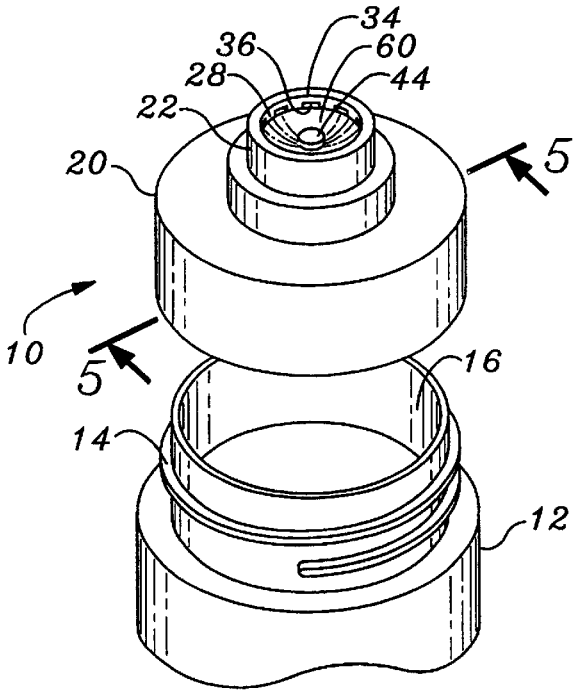
FIG. 1 is a partially exploded perspective view of a first embodiment of the present invention, a fluid dispensing valve that includes a cap and a dispensing valve body.

The above-described drawing figures illustrate the invention, a fluid dispensing valve 10 for controlling the flow of a fluid from a container 12. The fluid dispensing valve 10 includes a cap 20, a retainer 40, and a dispensing valve body 60. The fluid dispensing valve 10 is adapted to be mounted on the container 12 to contain the fluid despite the inversion of the container 12, and despite momentary shocks that might otherwise cause the fluid to flow through the fluid dispensing valve 10 and out of the container 12. However, in response to a sustained pressure, such as when the container 12 is squeezed by a user, or when the user attempts to suck the fluid from the container 12, the fluid dispensing valve 10 changes conformation to allow a large volume of the fluid to flow through the fluid dispensing valve and from the container 12 with minimal effort.

As shown in FIG. 1, the cap 20 includes a spout 22 and is adapted to engage the container 12 to close a container opening 16 of the container 12. In one embodiment, the cap 20 includes an internally threaded portion 24 that is shaped to threadedly engage an externally threaded portion 14 of the container 12. The externally threaded portion 14 is positioned around the container opening 16, so that threaded engagement of the cap 20 to the externally threaded portion 14 functions to close the container opening 16. The cap 20 is preferably constructed of injection molded plastic, although any relatively strong and rigid material could be used.

Figure 5:
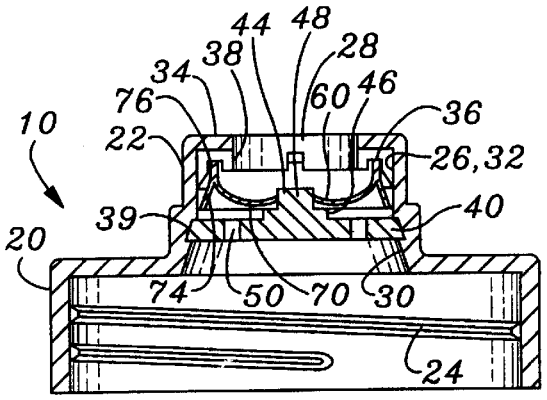
FIG. 5 is a sectional view thereof taken along line 5—5 in FIG. 1, illustrating the dispensing valve body in a sealed conformation.

As shown in FIG. 5, the spout 22 of the cap 20 defines a through-conduit 26 having a top opening 28, a bottom opening 30, and an interior spout surface 32 therebetween that is shaped to receive the dispensing valve body 60 as described below. The through-conduit 26 of the cap 20 includes an inner spout flange 34 adjacent the top opening 28. The inner spout flange 34 functions to hold the dispensing valve body 60 within the through-conduit 26 of the spout 22 and prevent it from falling out of the top opening 28. In one embodiment, the inner spout flange 34 includes a retaining rim 38 that functions to hold the dispensing valve body 60 in its correct position. The inner spout flange 34 and the retaining rim 38 preferably include at least one venting aperture 36 that enable air to vent into the container 12 without being blocked by the dispensing valve body 60, although alternative mechanisms can be devised by those skilled in the art to accomplish this same objective. As noted, a similar or inverse structure in the dispensing valve body 60 (such as an upwardly extending portion, not shown) could serve this same function. Obviously, many similar structures could be used in place of the inner spout flange 34 shown in the present embodiment, and the term inner spout flange 34 is intended to include any structure that at least partially closes the top opening 28 to prevent the dispensing valve body 60 from falling out of the cap 20.

As shown in FIG. 5, the through-conduit 26 preferably further includes a recessed ring 39 adjacent the bottom opening 30, the recessed ring 39 functioning to receive and hold the retainer 40, as described below. Alternative mechanisms can be used to lock the retainer 40 onto the cap 20, and such alternative mechanisms should be considered within the scope of the claimed invention; however, the use of the recessed ring 39 described is preferred because it locks the retainer 40 within the through-conduit 26 with such strength that it is extremely difficult to ever remove the retainer 40 once it has been installed. Such a strong connection is useful in the present invention because otherwise the retainer 40 might pose a choking hazard to a user drinking from the container 12.

Figure 4:
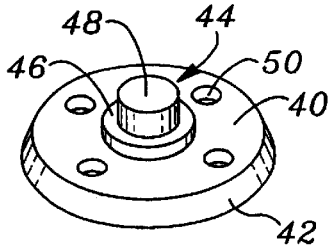
FIG. 4 is a top perspective view of a retainer used therein.
Figure 10:
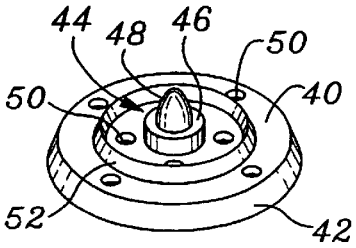
FIG. 10 is a top perspective view of a second embodiment of the retainer.
Figure 12:
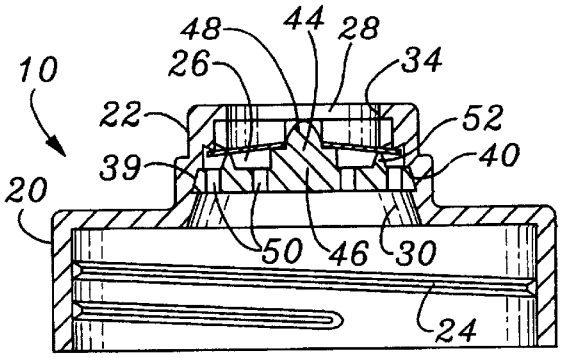
FIG. 12 is a sectional view thereof taken along line 12—12 in FIG. 11, illustrating the second embodiment of the dispensing valve body in the sealed conformation.
Figure 13:
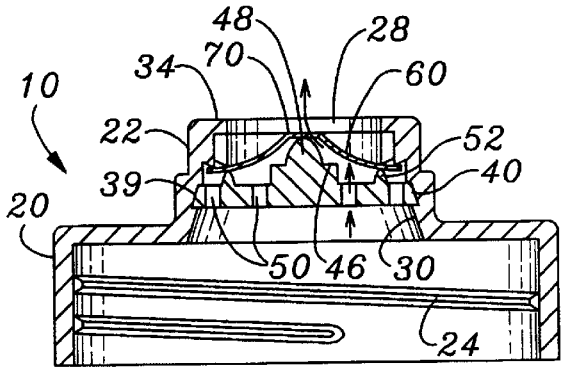
FIG. 13 is a sectional view thereof taken along line 12—12 in FIG. 11, illustrating the second embodiment of the dispensing valve body in the dispensing conformation.

The retainer 40 includes a retainer perimeter 42, an upwardly extending plug 44, and at least one flow aperture 50 through the retainer 40. The retainer perimeter 42, shown in FIGS. 4 and 10, is adapted to engage the spout 22 adjacent the bottom opening 30. In one embodiment, the retainer perimeter 42 is shaped and tapered to frictionally engage the recessed ring 39 described above. This structure is useful because it is very strong, and prevents the retainer 40 from accidentally disengaging from the cap 20, an important feature if an infant is to be able to drink from the container 12 without danger of choking on one of the components of the fluid dispensing valve 10. Obviously, many mechanisms could be used to attach the retainer 40 to the cap 20, including a threaded engagement, an adhesive, or other equivalent mechanism. Furthermore, it is also possible to provide the retainer 40 as integrally molded with the cap 20, and provide the inner spout flange 34 as a separate component that snaps on or otherwise engages the spout 22. Such a reversal is expressly considered within the scope of the described claims despite the fact that it reduces the retainer perimeter 42 to a mere abstract construct within the integrally molded part.

The upwardly extending plug 44 is shown in FIGS. 1, 4, 5, 11, 10, and 12. As shown in FIGS. 4, 5, 10, and 12, the upwardly extending plug 44 includes a plug shoulder 46 at its base and an upwardly extending portion 48 that fits through the dispensing valve body 60 to selectively seal the dispensing valve body 60, as described below. The dispensing valve body 60 abuts to the plug shoulder 46, which serves to further seal the dispensing valve body 60 as well as support the dispensing valve body 60 in its correct position, also described in greater detail below. The upwardly extending portion 48 can be generally cylindrical, as shown in FIG. 4; or the upwardly extending portion 48 can have an alternative shape, including but not limited to a conical shape as shown in FIG. 10. While these shapes are currently preferred, this should not be construed to limited the invention to these shapes, and those skilled in the art can utilize alternative shapes, and such alternatives should be considered within the scope of the claimed invention. The combination of the dispensing valve body 60 and the upwardly extending plug 44 enable the fluid dispensing valve 10 to dispense very large fluid from the container 12, and also enables the fluid dispensing valve 10 to dispense thick liquids such as shampoo, liquid soap, and ketchup.

As shown in FIGS. 4, 5, 10, and 12, the at least one flow aperture 50 of the retainer 40 are disposed to allow the fluid to flow out of the container 12 and be dispensed through the fluid dispensing valve 10, and then allow air to vent back into the container 12. Any number of arrangements can be devised by those skilled in the art, and two acceptable arrangements are described below. In the first embodiment, shown in FIG. 4, almost any arrangement of one or more apertures will serve. In the second embodiment, as shown in FIG. 10, at least one of the at least one flow aperture 50 must be located on either side of a support ridge 52, described below, so that fluid can flow through one and air can vent through the other.

As shown in FIGS. 4 and 10, the retainer 40 is preferably a generally disk-shaped component and is constructed of a strong, rigid material such as plastic, although those skilled in the art can select any number of other shapes and/or materials, including metal or any other material with suitable qualities. Additional features, such as a support ridge 52 shown in FIG. 10, can be added to contribute to the proper function of the fluid dispensing valve 10, as described below. It is worth noting that any features added to either the cap 20 or the retainer 40 can also be provided, in inverse, on the dispensing valve body 60, and such an inversion should be considered within the scope of the claimed invention. For example, instead of providing the support ridge 52 shown, the dispensing valve body 60 itself might be constructed with an equivalent structure (not shown) which would serve the same function as the support ridge 52. Such inverse structures are considered within the scope of the claimed invention.

As shown in FIGS. 2, 3, 5–9, and 12–14, the dispensing valve body 60 is shaped to be mounted upon the upwardly extending plug 44 and inserted through the bottom opening 30 and into the through-conduit 26 of the spout 22, thereby selectively sealing the through-conduit 26, as described below. The dispensing valve body 60 is bounded by an exterior surface 62, an interior surface 64, a valve perimeter 66, and a dispensing orifice perimeter 68 that defines a flow orifice 67. The dispensing orifice perimeter 68 is shaped to fit securely around and seal against the upwardly extending plug 44. The valve perimeter 66 is shaped to fit within the spout 22 and form a sealing relationship with the interior spout surface 32 or equivalent surface. The interior spout surface 32 can include part of the retainer 40 or the inner spout flange 34 because the dispensing valve body 60 could potentially form a sealing relationship with components of any of these elements; however, the seal is preferably against the interior spout surface 32 of the spout 22 itself, as shown in both of the illustrated embodiments. The dispensing valve body 60 is constructed of a resilient material, preferably a molded rubber or plastic component.

Figure 2:
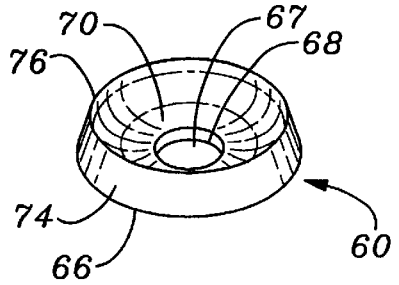
FIG. 2 is a top perspective view of the dispensing valve body used therein.
Figure 3:
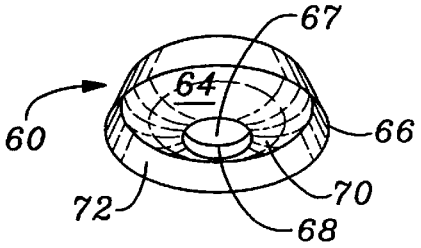
FIG. 3 is a bottom perspective view thereof.
Figure 6:
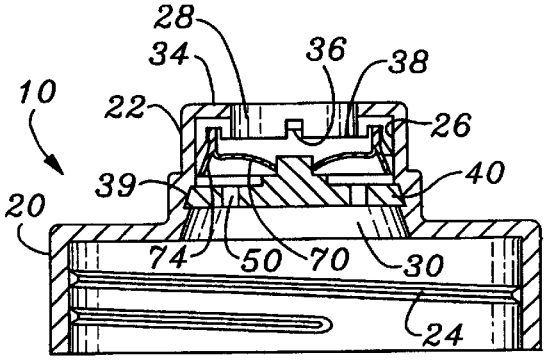
FIG. 6 is a sectional view thereof taken along line 5—5 in FIG. 1, illustrating the dispensing valve body moving from the sealed conformation towards a dispensing conformation.
Figure 7:
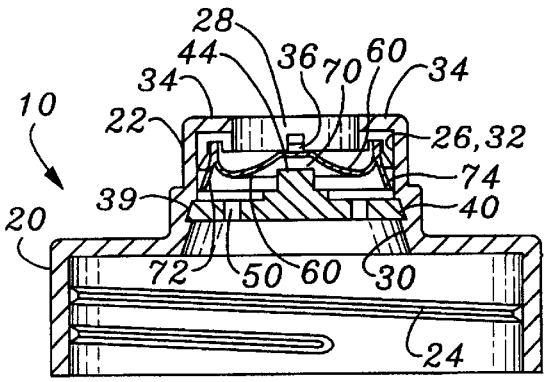
FIG. 7 is a sectional view thereof taken along line 5—5 in FIG. 1, illustrating the dispensing valve body in the dispensing conformation.

As shown in FIGS. 2 and 3, the dispensing valve body 60 includes an interior portion 70 of the dispensing valve body 60, adjacent the dispensing orifice perimeter 68, that is formed of a resilient material that can change conformation from a sealed conformation to a dispensing conformation. In the sealed conformation, shown in FIG. 5, the dispensing orifice perimeter 68 is positioned securely around and sealed against the upwardly extending plug 44. As shown in FIG. 6, the interior portion 70 changes from the sealed conformation to the dispensing conformation when the pressure against the interior surface 64 exceeds the pressure against the exterior surface 62. In the dispensing conformation, as shown in FIG. 7, the dispensing orifice perimeter 68 is lifted out of sealing contact with the upwardly extending plug 44. Once the dispensing orifice perimeter 68 is lifted out of contact with the upwardly extending plug 44, the fluid is able to flow freely through the flow orifice 67. Since the flow orifice 67 can be made quite large, this can enable a large volume of fluid flow, or flow a thick fluid, without restriction. A second embodiment displays similar features, as shown in FIGS. 9 and 12–14.

Figure 8:
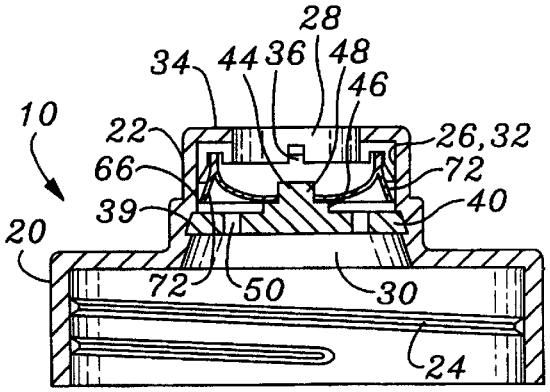
FIG. 8 is a sectional view thereof taken along line 5—5 in FIG. 1, illustrating the dispensing valve body in a venting conformation.
Figure 11:
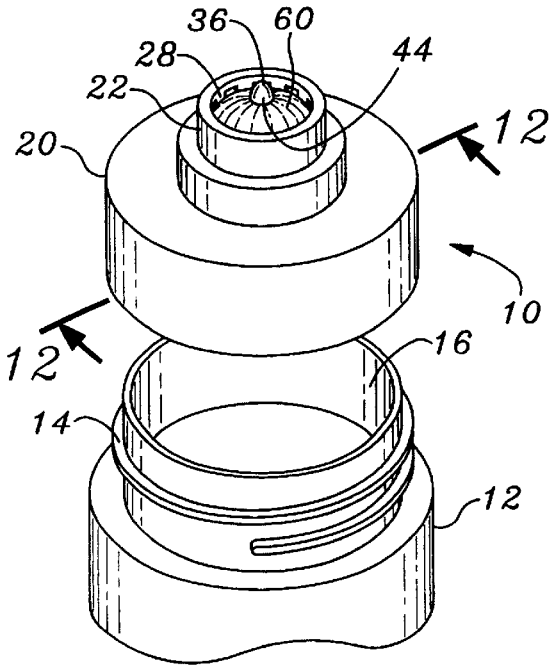
FIG. 11 is a partially exploded perspective view of a second embodiment of the fluid dispensing valve.
Figure 9:
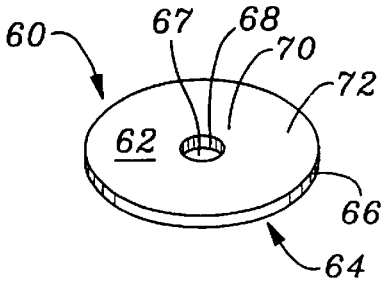
FIG. 9 is a top perspective view of a second embodiment of the dispensing valve body.
Figure 14:
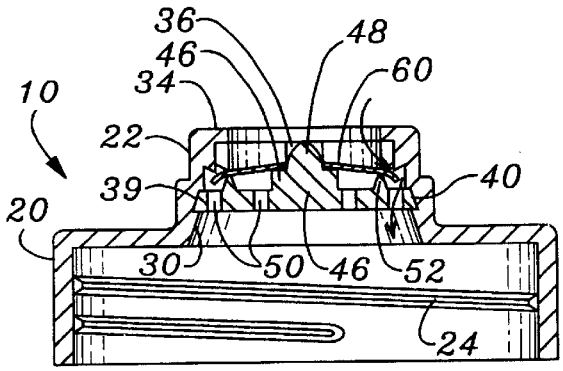
FIG. 14 is a sectional view thereof taken along line 12—12 in FIG. 11, illustrating the second embodiment of the dispensing valve body in the venting conformation.

As shown in FIGS. 2, 3, 5–9, and 12–14, the dispensing valve body 60 further includes an exterior portion 72, adjacent the valve perimeter 66, that is formed of a resilient material that can change conformation from an initial conformation to a venting conformation. In the is initial conformation, shown in FIGS. 5 and 12, the valve perimeter 66 is positioned securely around and sealed against the interior spout surface 32 to prevent the fluid from leaking around the dispensing valve body 60. As shown in FIGS. 8 and 14, when the pressure against the exterior surface 62 exceeds the pressure against the interior surface 64, the exterior portion 72 is pushed to the venting conformation in which the valve perimeter 66 is out of sealing contact with the interior spout surface 32.

In the first embodiment of the fluid dispensing valve 10, shown in FIGS. 1–8, the exterior portion 72 is formed by a venting flange 74 that extends outwardly and downwardly from a connection ridge 76 formed by the integral joining of the venting flange 74 and the interior portion 70. The connection ridge 76 is shaped to contact the inner spout flange 34 between the retaining rim 38 and the interior spout surface 32 and thereby hold the dispensing valve body 60 in its correct position. The at least one venting aperture 36 allows air to vent past the connection ridge 76. The angle of the venting flange 74 with respect to the interior spout surface 32 facilitates insertion of the dispensing valve body 60 into the spout 22, and further facilitates venting because the venting flange 74 can hinge along the connection ridge 76.

A second embodiment of the fluid dispensing valve 10 is shown in FIGS. 9–14. In this embodiment, the fluid dispensing valve 10 includes a dispensing valve body 60 that is generally flat and disk-shaped. In this embodiment, the flat shape of the exterior portion 72 enables the retaining rim 38 to form part of the seal. This embodiment functions best with a retainer 40 that includes the support ridge 52, because the support ridge 52 functions to support the dispensing valve body 60 so that the exterior portion 72 properly contacts the interior spout surface 32, preferably including the retaining rim 38. In this embodiment, the plug shoulder 46 preferably extends upwards past the retaining rim 38, so that the upward pressure of the plug shoulder 46 biases the exterior portion 72 towards the retaining rim 38, thereby increasing the strength of the seal formed.

During manufacture of the fluid dispensing valve 10, the cap 20, the retainer 40, and the dispensing valve body 60 are preferably injection molded as described above. The dispensing valve body 60 is mounted upon the retainer 40 such that the upwardly extending portion 48 is inserted through the flow orifice 67 formed by the dispensing orifice perimeter 68, and such that the dispensing valve body 60 rests upon the plug shoulder 46. The retainer 40 is then positioned adjacent the bottom opening 30 such that the dispensing valve body 60 is positioned within the cap 20. The retainer 40 is then locked onto the cap 20, preferably by pushing the retainer 40 into the bottom opening 30 until the retainer perimeter 42 snaps into the recessed ring 39. Once the retainer 40 is locked into place, it is very difficult to remove, thereby preventing the fluid dispensing valve 10 from coming apart after assembly. The fluid dispensing valve 10 is then attached to the container 12, preferably by threadedly mounting the cap 20 into the container 12.

Once assembled, the container 12 can be inverted and the fluid dispensing valve 10 will prevent any of the fluid in the container 12 from escaping. The fluid dispensing valve 10 will even prevent leakage if the container 12 is subjected to a jolt, such as if the container 12 falls onto the ground. Short periods of pressure are absorbed by the resilience of the dispensing valve body 60 while the dispensing valve body 60 remains seated upon the upwardly extending portion 48 of the upwardly extending plug 44.

If a sustained pressure is exerted upon the fluid, such as by squeezing the container 12 or sucking on the spout 22, the pressure causes the dispensing valve body 60 to slide off of the upwardly extending portion 48 and move from the sealed conformation to the dispensing conformation. While the claims speak in terms of squeezing the container 12, this is expressly considered to include equivalent procedures such as sucking on the spout 22 or otherwise raising the pressure within the container 12 or lowering the pressure outside the fluid dispensing valve 10. Once in the dispensing conformation, fluid can flow through the flow orifice 67. The flow orifice 67 can be made fairly large without impairing the ability of the fluid dispensing valve 10 to seal the container 12, as long as the flow orifice 67 is associated with a suitably large upwardly extending portion 48. If the flow orifice 67 is large, it enables a large volume of the fluid to be dispensed, even if the fluid is thick, such as shampoo, liquid soap, and ketchup.

Once the dispensing pressure is released, the natural resilience of the container 12 serves to create a vacuum within the container 12 that pulls downward on the dispensing valve body 60 and thereby returns the dispensing valve body 60 from the dispensing conformation to the sealed conformation. The pressure then serves to pull down on the exterior portion 72 of the dispensing valve body 60, moving the dispensing valve body 60 from the initial conformation to the venting conformation. In the venting conformation, described above, the valve perimeter 66 and/or the exterior portion 72 loses contact with the inner spout surface 32 and/or the retaining rim 38 of the inner spout flange 34. Air is able to flow through the at least one venting aperture 36 and past the dispensing valve body 60 and into the container 12 until pressure is normalized. Once there is no vacuum within the container 12, and the container 12 has returned to its original shape, the natural resilience of the dispensing valve body 60 returns the exterior portion 72 to the sealed conformation and once again prevents the fluid from leaking through the fluid dispensing valve 10.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fluid dispensing valve for controlling the flow of a fluid through a cap and a retainer, the cap having a spout that defines a through-conduit having a top opening and a bottom opening, the through-conduit having an interior spout surface that terminates in an inner spout flange, the retainer having a retainer perimeter, at least one flow aperture through the retainer, and an upwardly extending plug, the retainer perimeter being adapted to engage the spout adjacent the bottom opening, the fluid dispensing valve comprising:

a dispensing valve body bounded by an exterior surface, an interior surface, a valve perimeter, and a dispensing orifice perimeter, the dispensing orifice perimeter being shaped to fit securely around and seal against the upwardly extending plug, the valve perimeter being shaped to fit within the spout and form a sealing relationship with the interior spout surface, and an interior portion of the dispensing valve body, adjacent the dispensing orifice perimeter, being formed of a resilient material that can change conformation from a sealed conformation, wherein the dispensing orifice perimeter is positioned securely around and sealed against the upwardly extending plug, to a dispensing conformation, wherein the dispensing orifice perimeter is lifted out of sealing contact with the upwardly extending plug, when the pressure against the interior surface exceeds the pressure against the exterior surface; and wherein the dispensing valve body further includes an exterior portion, adjacent the valve perimeter, that is formed of a resilient material that can change conformation from an initial conformation, wherein the valve positioned securely around and sealed against the interior spout surface, to a venting conformation, wherein the valve perimeter in pushed out of sealing contact with the interior spout surface, when the pressure against the interior surface exceeds the pressure against the interior surface.

2. The fluid dispensing valve of claim 1, wherein the exterior portion includes a venting flange that extends outwardly and downwardly from a connection ridge formed by the integral joining of the venting flange and the interior portion.

3. A fluid dispensing valve comprising:

a cap having a spout that defines a through-conduit having a top opening and a bottom opening, the through-conduit having an interior spout surface that terminates in an inner spout flange;

a retainer having a retainer perimeter, at least one flow aperture through the retainer, and an upwardly extending plug, the retainer perimeter being adapted to engage the spout adjacent the bottom opening; and a dispensing valve body bounded by an exterior surface, an interior surface, a valve perimeter, and a dispensing orifice perimeter, the dispensing orifice perimeter being shaped to fit securely around and seal against the upwardly extending plug, the valve perimeter being shaped to fit within the spout and form a scaling relationship with the interior spout surface, wherein an interior portion of the dispensing valve body, adjacent the dispensing orifice perimeter, is formed of a resilient material that can change conformation from a sealed conformation, wherein the dispensing orifice perimeter is positioned securely around and sealed against the upwardly extending plug, to a dispensing conformation, wherein the dispensing orifice perimeter is lifted out of sealing contact with the upwardly extending plug, when the pressure against the interior surface exceeds the pressure against the exterior surface, and wherein an exterior portion of the dispersing valve body includes a venting flange that extends outwardly and downwardly from a connection ridge formed by the integral joining of the venting flange and the interior portion.

4. A method for assembling a fluid dispensing valve, the method comprising the steps of:

providing a fluid dispensing valve having a cap, a retainer, and a dispensing valve body, the cap having a spout that defines a through-conduit, the retainer having an upwardly extending plug and at least one flow aperture therethrough, and the dispensing valve body bounded by an exterior surface, an interior surface, a valve perimeter, and a dispensing orifice perimeter, the dispensing orifice perimeter being shaped to fit securely around and seal against the upwardly extending plug, and the valve perimeter being shaped to fit within the spout, wherein the dispensing valve body further includes an exterior portion, adjacent the valve perimeter, that is formed of a resilient material that can change conformation from an initial conformation to a venting conformation;

mounting the dispensing valve body on the retainer such that the upwardly extending plug is positioned through the flow aperture and forms a sealing relationship with the dispensing orifice perimeter, and wherein the exterior portion, is positioned in an initial conformation, wherein the valve perimeter is positioned securely around and sealed against the interior spout surface, but able to change conformation to a venting conformation, wherein the valve perimeter is pushed out of sealing contact with the interior spout surface, when the pressure against the exterior surface exceeds the pressure against the interior surface; and mounting the retainer on the cap such that the dispensing valve body seals the through-conduit.

5. A method for dispensing fluid from a container, the method comprising the steps of:

providing a container of fluid, the container having an a container opening;

providing a fluid dispensing valve having a cap, a retainer, and a dispensing valve body, the cap having a spout that defines a through-conduit, the retainer having an upwardly extending plug and at least one flow aperture therethrough, and the dispensing valve body bounded by an exterior surface, an interior surface, a valve perimeter, and a dispensing orifice perimeter, the dispensing orifice perimeter defining a flow aperture that is shaped to fit securely around and seal against the upwardly extending plug, and the valve perimeter being shaped to fit within the spout;

mounting the dispensing valve body on the retainer such that the upwardly extending plug is positioned through the flow aperture and forms a sealing relationship with the dispensing orifice perimeter;

mounting the retainer on the cap such that the dispensing valve body seals the through-conduit;

mounting the cap on the container such that the cap covers the container opening;

squeezing the container such that pressure from within the container pushes the dispensing orifice perimeter of the dispensing valve body is pushed off of the upwardly extending plug and the fluid flows through the flow aperture; and releasing the container such that pressure from outside the container pushes the dispensing orifice perimeter back onto the upwardly extending plug, thereby resealing the flow aperture, and the dispensing valve body deforms to allow the valve perimeter to lose contact with the through-conduit and allow air to vent back into the container through the at least one flow aperture.

* * * * *